US008535050B2

(12) United States Patent
Kuroda

(10) Patent No.: US 8,535,050 B2
(45) Date of Patent: Sep. 17, 2013

(54) FORCED FLUE TYPE COMBUSTION DEVICE

(75) Inventor: Shinji Kuroda, Nagoya (JP)

(73) Assignee: Rinnai Corporation, Aichi (JP)

( * ) Notice: Subject to any disclaimer, the term of this patent is extended or adjusted under 35 U.S.C. 154(b) by 1249 days.

(21) Appl. No.: 11/488,647

(22) Filed: Jul. 19, 2006

(65) Prior Publication Data

US 2008/0044778 A1 Feb. 21, 2008

(51) Int. Cl.
*F23N 1/02* (2006.01)
*A01G 13/06* (2006.01)

(52) U.S. Cl.
USPC ..... 431/19; 431/18; 126/99 R; 126/116 A

(58) Field of Classification Search
USPC ..... 126/502, 515–518, 116 A; 431/19, 431/20
See application file for complete search history.

(56) References Cited

U.S. PATENT DOCUMENTS 4,251,025 A * 2/1981 Bonne et al. ..... 236/14
4,483,672 A * 11/1984 Wallace et al. ..... 431/20
4,712,996 A * 12/1987 Adams et al. ..... 431/20
4,752,210 A * 6/1988 Trent ..... 431/20
5,222,888 A * 6/1993 Jones et al. ..... 431/20
5,433,188 A * 7/1995 Narang ..... 126/110 R
5,658,140 A * 8/1997 Kondou et al. ..... 431/90
6,234,164 B1 * 5/2001 Yasui ..... 126/110 R
6,257,870 B1 * 7/2001 Hugghins et al. ..... 431/18
6,377,426 B2 * 4/2002 Hugghins et al. ..... 361/23

FOREIGN PATENT DOCUMENTS

JP 2000-310419 11/2000

* cited by examiner

*Primary Examiner* — Kang Hu
*Assistant Examiner* — J Crockett Hailey, III
(74) *Attorney, Agent, or Firm* — Edwards Wildman Palmer LLP

(57) ABSTRACT

A forced flue type combustion device in which an orifice is provided in at least one of an air supply passage and an exhaust passage, and in which the existence/nonexistence of a clog is determined on the basis of a detected pressure difference between the pressures on the upstream and downstream sides of the orifice, is arranged so that the existence/nonexistence of a clog can be determined with accuracy even during weak combustion with a low rotational speed of the combustion fan. Processing for increasing the rotational speed of the combustion fan is intermittently executed during weak combustion. During weak combustion, clogging determination processing based on the detected pressure difference value is executed only when the rotational speed of the combustion fan is increased. Clogging determination processing is started after the rotational speed of the combustion fan has become stable.

8 Claims, 2 Drawing Sheets

FORCED FLUE TYPE COMBUSTION DEVICE

BACKGROUND OF THE INVENTION

1. Field of the Invention

The present invention relates to a forced flue type combustion device which has a combustion chamber incorporating a burner, an air supply passage for supplying combustion air to the interior of the combustion chamber, an exhaust passage for discharging flue gas in the combustion chamber generated by combustion with a burner, and a combustion fan interposed in one of the air supply passage and the exhaust passage, and in which combustion air is forcibly supplied to the interior of the combustion chamber by the rotation of the combustion fan, while flue gas in the combustion chamber is forcibly exhausted out of the combustion chamber by the rotation of the combustion fan.

2. Description of the Related Art

When the air supply passage or the exhaust passage in this kind of combustion device clogs, the rate at which combustion air supplied to the combustion chamber is reduced relative to that corresponding to the rotational speed of the combustion fan, resulting in incomplete combustion due to deficiency of air.

A forced flue type combustion device is hitherto known which is designed to avoid this problem and which has an orifice provided in at least one of the air supply passage and the exhaust passage, a pressure difference sensor for detecting the difference between the gas pressure on the upstream side of the orifice and the gas pressure on the downstream side of the orifice, and a clogging determination elements configured to determine whether or not the air supply passage and/or the exhaust passage is clogged on the basis of the detected pressure difference value from pressure difference sensor (see, for example, Japanese Patent Laid-Open No. 2000-310419). The difference between the gas pressure on the upstream side of the orifice and the gas pressure on the downstream side of the orifice changes according to the rate of flow of gas through the orifice. Therefore, when the air supply passage or the exhaust passage is clogged so that the gas flow rate is reduced, the detected pressure difference value from the pressure difference sensor is reduced. Thus, it is possible to determine the existence/nonexistence of a clog on the base of the detected pressure difference value by the clogging determination elements. When it is determined that the passage is clogged, the combustion with the burner is stopped to prevent the occurrence of incomplete combustion.

Since the rotational speed of the combustion fan is reduced during weak combustion with the burner, the rate at which gas flows through the orifice is reduced to a small value even in a normal state in which each of the air supply passage and the exhaust passage is not clogged. During weak combustion, therefore, the amount of change in the detected pressure difference value between normal and clogged states is extremely small and the existence/nonexistence of a clog cannot be determined with accuracy.

SUMMARY OF THE INVENTION

In view of the above-described problem, an object of the present invention is to provide a forced flue type combustion device capable of accurately determining existence/nonexistence of a clog even during weak combustion.

To achieve the above-described object, according to the present invention, there is provided a forced flue type combustion device which has a combustion chamber incorporating a burner, an air supply passage for supplying combustion air to the interior of the combustion chamber, an exhaust passage for discharging flue gas in the combustion chamber generated by combustion with a burner, and a combustion fan interposed in one of the air supply passage and the exhaust passage, and in which combustion air is forcibly supplied to the interior of the combustion chamber by the rotation of the combustion fan, while flue gas in the combustion chamber is forcibly exhausted out of the combustion chamber by the rotation of the combustion fan, the combustion device includes an orifice provided in at least one of the air supply passage and the exhaust passage, a pressure difference sensor for detecting the difference between the gas pressure on the upstream side of the orifice and the gas pressure on the downstream side of the orifice, clogging determination means for determining whether a clog exists in at least any one of the air supply passage and the exhaust passage, a pressure difference sensor for detecting the difference between the gas pressure on the upstream side of the orifice and the gas pressure on the downstream side of the orifice, clogging determination elements configured to determine whether a clog exists in at least any one of the air supply passage and the exhaust passage on the basis of a detected pressure difference value from the pressure difference sensor, and determination control elements configured to control the execution of determination by the clogging determination elements, wherein during weak combustion in which the combustion fan rotates at a rotational speed equal to or lower than a predetermined speed, the determination control elements is arranged to intermittently execute speed increasing processing to increase the rotational speed of the combustion fan to a speed higher than the predetermined speed, and execute determination by the clogging determination elements only when the rotational speed of the combustion fan is increased by the speed increasing processing.

According to the present invention, the rate of flow of gas through the orifice is increased by increasing the rotational speed of the combustion fan by means of speed increasing processing during weak combustion to increase the amount of change in the detected pressure difference value between normal and clogged states. Clogging determination based on the detected pressure difference value is made when the rotational speed of the combustion fan is increased. Even during weak combustion, therefore, the existence/nonexistence of a clog can be determined with accuracy. Because the combustion fan speed increasing processing is only performed periodically, there is no bad influence on the combustion with the burner.

During the transient time period during which the rotational speed of the combustion fan is increased, the rate of flow of gas through the orifice is instable and the detected pressure difference value is also instable. Therefore there is a possibility of a determination error in clogging determination, if clogging determination is made during the transient time period during which the rotational speed of the combustion fan is increased. Therefore, it is desirable that the determination control elements be arranged to execute determination by the clogging determination elements after the rotational speed of the combustion fan has become stable at the speed increased by speed increasing processing. It is thereby ensured that clogging determination processing is performed while the rate of flow of gas through the orifice and the detected pressure difference value are stable. In this way, prevention of erroneous determination is achieved.

In the present invention, it is desirable that the determination control elements be arranged to execute determination by the clogging determination elements at all times during combustion other than weak combustion in which the combustion fan is rotating at a speed higher than the above-mentioned predetermined speed. During combustion other than weak combustion, the rate of flow of gas through the orifice is high and the amount of change in the detected pressure difference value between normal and clogged states is increased. There is no erroneous determination problem under this condition. Clogging determination is made at all times to immediately detect clogging in the air supply passage or the exhaust passage when the clogging occurs.

In the embodiment described below, a clogging determination control shown in FIG. 2 corresponds to the above-described determination control elements, and steps S2 and S8 in FIG. 2 correspond to the above-described clogging determination elements.

DETAILED DESCRIPTION OF THE PREFERRED EMBODIMENT

Figure 1:
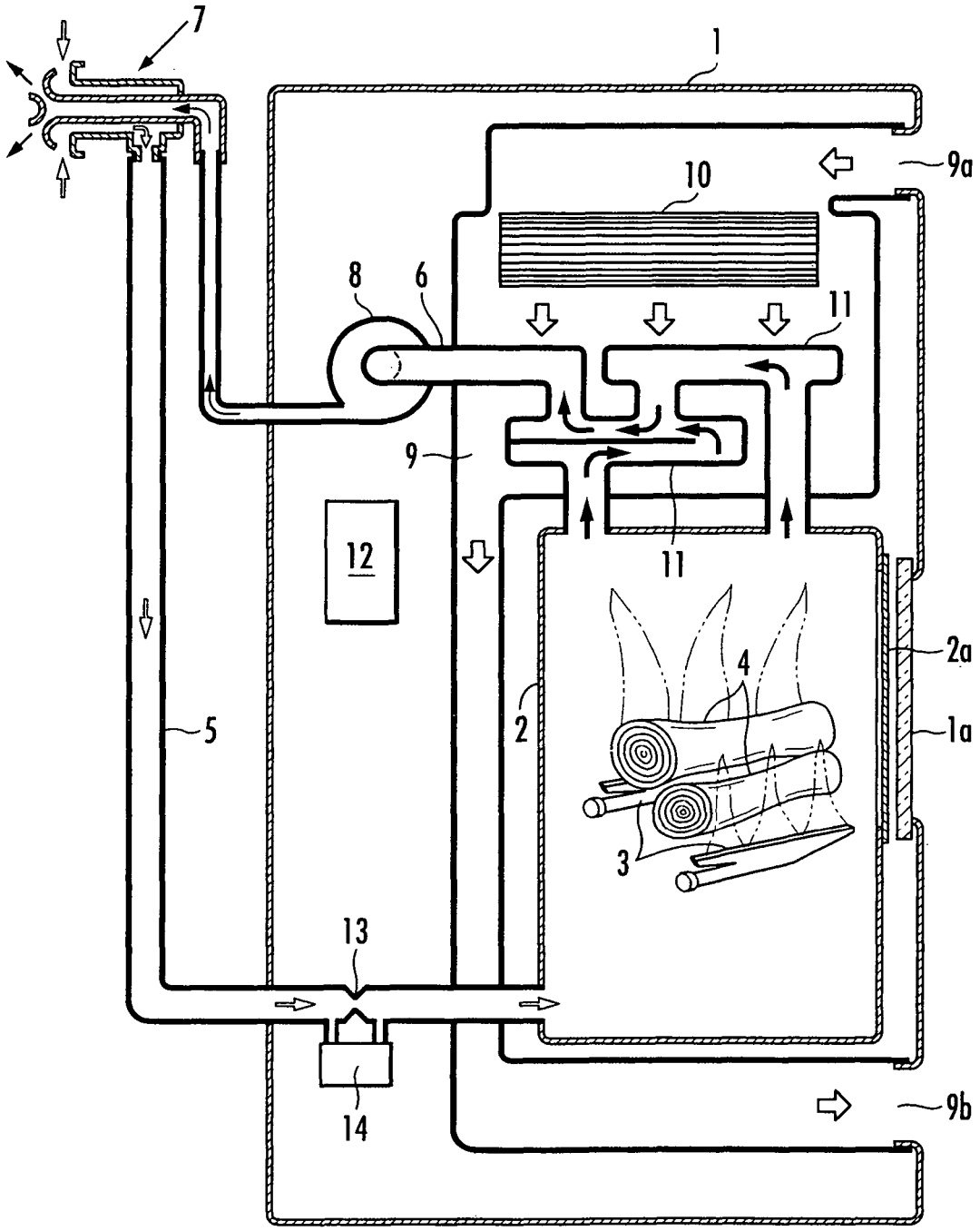
FIG. 1 is sectional view of a forced flue type heater which represents an embodiment of the present invention.

FIG. 1 shows a forced flue type heater in the form of a stove which represents an embodiment of the combustion device of the present invention. This heater has a box-shaped housing 1, in which a combustion chamber 2 is housed. The combustion chamber 2 incorporates a burner 3 and an imitation firewood 4. An opening is formed in a front side portion of the combustion chamber 2 and covered with a glass plate 2*a*. An opening facing the window portion of the combustion chamber 2 is also formed in a front side portion of the housing 1. A window glass 1*a* is fitted in this opening. A person can see the interior of the combustion chamber 2 through the window glass 1*a* to have a visual impression such as to feel as if the imitation firewood 4 is burning during burning of the burner 3.

An air supply passage 5 and an exhaust passage 6 are respectively connected to lower and upper portions of the combustion chamber 2. The upstream end of the air supply passage 5 and the downstream end of the exhaust passage 6 communicate with the outdoor atmosphere through an air supply/exhaust top 7 having a double tube structure using inner and outer tubes. A combustion fan 8 is interposed in the exhaust passage 6. When the combustion fan 8 is rotated, flue gas generated by combustion with the burner 3 is forcibly exhausted into the outdoor atmosphere through the exhaust passage 6. Simultaneously, air in the outside atmosphere is forcibly supplied as combustion air to the interior of the combustion chamber 2 through the air supply passage 5 by a drawing force accompanying the forced exhaustion of the flue gas.

An air passage 9 is defined in the housing 1 between an inlet port 9*a* opened in an upper front portion of the housing 1 and an outlet port 9*b* opened in a lower front portion of the housing 1. A convection fan 10 and a heat exchanger 11 interposed in the exhaust passage 6 are disposed in the air passage 9. When the convection fan 10 is rotated, room air is drawn in through the inlet port 9*a*, heated by the heat of flue gas in the heat exchanger 11, and blown as hot air into the room through the outlet port 9*b*.

Fuel gas is supplied to the burner 3 through a proportional valve (not shown) controlled by a controller 12 in the heater. The rate of combustion with the burner 3 is variably controlled according to the deviation of the room temperature from a set heating temperature, and the rotational speed of the combustion fan 8 is variably controlled in three stages: a high speed (H) stage, a medium speed (M) stage and a low speed (L) stage according to the rate of combustion with the burner 3.

There is a possibility of the air supply passage 5 or the exhaust passage 6 being clogged, for example, by intrusion of an extraneous matter such as tree leaves, or by snow in the air supply/exhaust top 7. In such a case, the rate at which combustion air is supplied to the combustion chamber 2 may be reduced to cause incomplete combustion with the burner 3 due to deficiency of air.

An orifice 13 and a pressure difference sensor 14 are therefore provided to detect the occurrence of such a clogged state in the air supply passage 5 and the exhaust passage 6. The orifice 13 is provided in the air supply passage 5. The pressure difference sensor 14 detects, the difference between the gas pressure on the upstream side of the orifice 13 and the gas pressure on the downstream side of the orifice 13. A detection signal from the pressure difference sensor 14 is input to the controller 12. The controller 12 executes control for determination of clogging based on the detected pressure difference value obtained by the pressure difference sensor 14.

Figure 2:
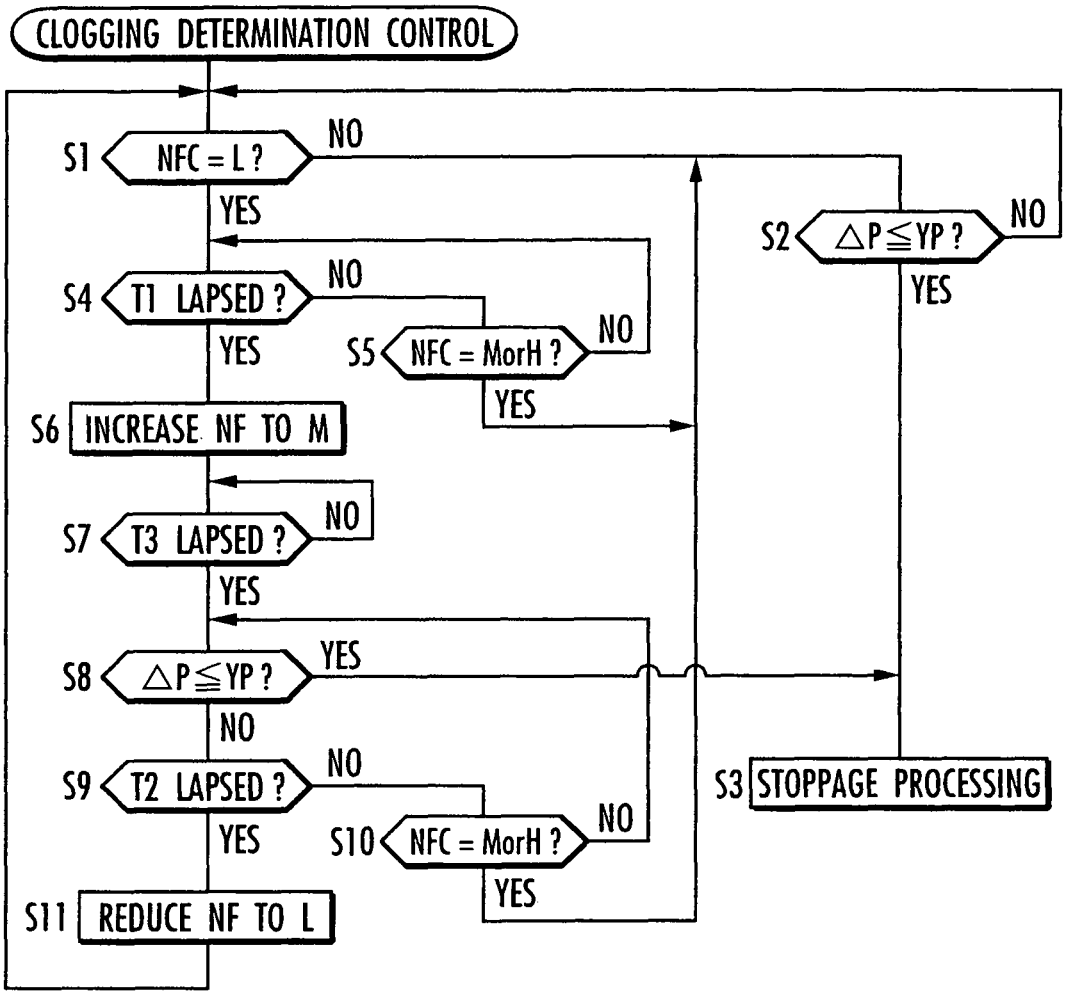
FIG. 2 is a flowchart showing details of clogging determination control performed by a controller in the heater.

Clogging determination control will be described with reference to FIG. 2. In clogging determination control, determination is first made in step S1 as to whether or not a value NFC indicating the rotational speed of the combustion fan 8 is L. NFC is L at the time of weak combustion when the burner 3 is burning at a combustion rate lower than a predetermined value. NFC is M or H when during combustion other than weak combustion. If NFC is M or H, the process advances to step S2 and determination is made as to whether or not the detected pressure difference value $\Delta P$ from the pressure difference sensor 14 has become equal to or lower than a predetermined clogging discrimination value YP.

When the air supply passage 5 or the exhaust passage 6 is clogged, the rate at which gas flows through the orifice 13 is reduced and the detected pressure difference value $\Delta P$ is also reduced. When $\Delta P \leqq YP$, it is determined that clogging has occurred. The process then advances to step S3 to execute stoppage processing. In stoppage processing, combustion with the burner 3 is stopped and the occurrence of clogging is notified. The clogging discrimination value YP is set to a comparatively large value with respect to NFC=H, and to a comparatively small value with respect to NFC=M.

If it is determined in step S2 that $\Delta P > YP$, the process returns to step S1. If the present combustion is not weak combustion, the process again advances to step S2. Thus, clogging determination processing on the basis of the detected pressure difference value $\Delta P$ in step S2 is executed at all times during combustion other than weak combustion.

During weak combustion of NFC=L, the rate of flow of gas through the orifice 13 is reduced and the detected pressure difference value $\Delta P$ is also reduced. Under this condition, the amount of change in the detected pressure difference value $\Delta P$ between the normal and clogged states is so small that it is difficult to accurately determine the existence/nonexistence of a clog based on the detected pressure difference value $\Delta P$.

Figure 3:
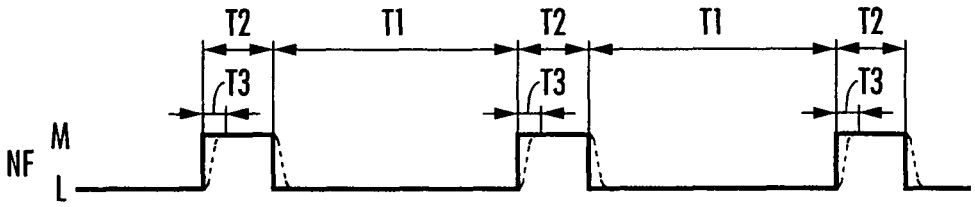
FIG. 3 is a time chart showing changes in rotational speed of a combustion fan during weak combustion in the heater.

In this embodiment, therefore, speed increasing processing for increasing the rotational speed NF of the combustion fan 8 from L to M is periodically executed during weak combustion, as shown in FIG. 3. That is, speed increasing processing is executed during predetermined short time periods T2 at predetermined time intervals T1 set comparatively long. During weak combustion, clogging determination processing based on the detected pressure difference value ΔP is executed only when the rotational speed NF of the combustion fan 8 is increased by speed increasing processing.

When speed increasing processing is performed, the actual rotational speed of the combustion fan 8 is changed as indicated by the broken line in FIG. 3. As is apparent from this, a certain amount of time period is required for stabilization of the actual rotational speed of the combustion fan 8 to M. During the transient time period during which the rotational speed of the combustion fan 8 is increased, the rate of flow of gas through the orifice 13 is instable and the detected pressure difference value ΔP is also instable. Therefore there is a possibility of a determination error in clogging determination, if clogging determination is made during the transient increasing time period. Therefore, a wait time T3 is set according to the time period necessary for stabilization of the actual rotational speed of the combustion fan 8 to M and clogging determination is made after a lapse of this wait time T3 from a start of speed increasing processing.

The above-described clogging determination control during weak combustion will be concretely described with reference to FIG. 2. When NFC=L is determined in step S1 during weak combustion, the process advances to step S4 and determination is made as to whether or not T1 has lapsed. If T1 has not lapsed, the process advances to step S5 and determination is made as to whether or not NFC has been changed from L to M or H by an increase in the rate of combustion with the burner 3. If NFC has been changed from L to M or H, the process advances to step S2. If NFC is still L, the process returns to step S4. After T1 has lapsed when NFC=L, the process advances to step S6 and speed increasing processing is performed to increase the rotational speed NF of the combustion fan 8 from L to M.

Determination is then made as to whether or not T3 has lapsed from the start of speed increasing processing in step S7. After the lapse of T3, the process advances to step S8 and determination is made as to whether or not the detected pressure difference value ΔP of the pressure difference sensor 14 has become equal to or lower than the predetermined clogging discrimination value YP. If ΔP≦YP, it is determined that the clogging has occurred. The process then advances to step S3 to execute stoppage processing. If ΔP>YP, it is determined that the clogging has not occurred. The process then advances to step S9 and determination is made as to whether or not T2 has lapsed from the start of speed increasing processing. If T2 has not lapsed, the process advances to step S10 and determination is made as to whether NFC has been changed from L to M or H. If NFC has been changed from L to M or H, the process advances to step S2. If NFC is still L, the process returns to step S8. If T2 has lapsed while NFC=L, processing for returning the rotational speed NF of the combustion fan 8 from M to L is performed in step S11 and the process thereafter returns to step S1.

In the above-described clogging determination control, the rate at which gas flows through the orifice 13 is increased by performing the combustion fan 8 speed increasing processing during weak combustion, thereby increasing the amount of change in detected pressure difference value ΔP between the normal and clogged states. Also, when the rotational speed NF of the combustion fan 8 is increased by speed increasing processing, clogging determination processing based on the detected pressure difference value ΔP is performed in step S8, thus enabling determination of the existence/nonexistence of a clog to be made with accuracy even during weak combustion. This clogging determination processing is performed after the rotational speed of the combustion fan 8 has become stable after being increased by speed increasing processing. Thus, clogging determination processing is performed while the rate of flow of gas through the orifice 13 and the detected pressure difference value ΔP are stable. In this way, prevention of erroneous determination is achieved. Because the combustion fan 8 speed increasing processing is only performed periodically, there is no bad influence of the processing on the combustion with the burner 3.

The rate of flow of gas through the orifice is increased during combustion other than weak combustion and the amount of change in the detected pressure difference value ΔP between the normal and clogged states is increased. There is no erroneous determination problem under this condition. In the above-described clogging determination control, clogging determination processing based on the detected pressure difference value ΔP in step S2 is executed at all times during combustion other than weak combustion to immediately detect clogging in the air supply passage 5 or the exhaust passage 6 when the clogging occurs.

The embodiment of the present invention has been described with reference to the drawings. The present invention, however, is not limited to the described embodiment. For example, while in the above-described embodiment the process advances to step S8 after determining in step S7 a lapse of the T3 from a start of speed increasing processing, the arrangement may alternatively be such that a rotational speed sensor is provided on the combustion fan 8 and the process advances to step S8 after determination of the completion of stabilization of the detected speed from the rotational speed sensor to M.

While in the above-described embodiment the combustion fan 8 is interposed in the exhaust passage 6, it may alternatively be interposed in the air supply passage 5. Further, while in the above-described embodiment the orifice 13 is provided in the air supply passage 5, it may alternatively be provided in the exhaust passage 6 or in each of the air supply passage 5 and the exhaust passage 6.

While the above-described embodiment is an application of the present invention to a forced flue type heater, the present invention can also be applied in a similar way to forced flue type combustion devices such as hot water supply devices other than the heater.

What is claimed is:

1. A forced flue type combustion device which has a combustion chamber incorporating a burner, an air supply passage for supplying combustion air to the interior of the combustion chamber, an exhaust passage for discharging flue gas in the combustion chamber generated by combustion with a burner, and a combustion fan interposed in one of the air supply passage and the exhaust passage, and in which combustion air is forcibly supplied to the interior of the combustion chamber by the rotation of the combustion fan, while flue gas in the combustion chamber is forcibly exhausted out of the combustion chamber by the rotation of the combustion fan, the combustion device comprising:

an orifice provided in at least one of the air supply passage and the exhaust passage;

a pressure difference sensor for detecting the difference between the gas pressure on the upstream side of the orifice and the gas pressure on the downstream side of the orifice;

clogging determination elements configured to determine whether a clog exists in at least any one of the air supply passage and the exhaust passage on the basis of a detected pressure difference value from the pressure difference sensor; and determination control elements configured to control the execution of determination by the clogging determination elements, wherein during weak combustion in which the combustion fan rotates at a rotational speed equal to or lower than a first predetermined speed, the determination control elements are arranged to execute a first processing for a first predetermined period of time and a second processing for a second predetermined period of time longer than the first predetermined period of time, the first and second processing being performed alternately and repeatedly and to execute the determination by the clogging determination in an interval on or after the first processing is executed and before the second processing is executed, wherein during weak combustion, the burner burns at a combustion rate lower than a predetermined value, and wherein the first processing includes a processing to increase the rotational speed of the combustion fan from the first predetermined speed to a second predetermined speed higher than the first predetermined speed and thereafter maintain the rotational speed of the combustion fan at the second predetermined speed, and the second processing includes a processing to decrease the rotational speed of the combustion fan from the second predetermined speed to the first predetermined speed and thereafter maintain the rotational speed of the combustion fan at the first predetermined speed.

2. The forced flue type combustion device according to claim 1, wherein the determination control elements are arranged to execute determination by the clogging determination elements at all times during combustion other than weak combustion in which the combustion fan is rotating at a speed higher than the first predetermined speed.

3. The forced flue type combustion device according to claim 1, further comprising a controller for controlling the rate of combustion.

4. The forced flue type combustion device according to claim 3, wherein the controller controls an amount of fuel and intake air supplied to the burner.

5. The forced flue type combustion device according to claim 4 wherein, the rate of combustion is variably controlled according to a deviation of a temperature from a preset temperature.

6. The forced flue type combustion device according to claim 5 wherein, the rotational speed of the combustion fan is controlled in three stages: a high speed (H) stage, a medium speed (M) stage and a low speed (L) stage based on the rate of combustion.

7. A forced flue type combustion device which has a combustion chamber incorporating a burner, an air supply passage for supplying combustion air to the interior of the combustion chamber, an exhaust passage for discharging flue gas in the combustion chamber generated by combustion with a burner, and a combustion fan interposed in one of the air supply passage and the exhaust passage, and in which combustion air is forcibly supplied to the interior of the combustion chamber by the rotation of the combustion fan, while flue gas in the combustion chamber is forcibly exhausted out of the combustion chamber by the rotation of the combustion fan, the combustion device comprising:

an orifice provided in at least one of the air supply passage and the exhaust passage;

a pressure difference sensor for detecting the difference between the gas pressure on the upstream side of the orifice and the gas pressure on the downstream side of the orifice;

clogging determination elements configured to determine whether a clog exists in at least any one of the air supply passage and the exhaust passage on the basis of a detected pressure difference value from the pressure difference sensor; and determination control elements configured to control the execution of determination by the clogging determination elements, wherein during weak combustion in which the combustion fan rotates at a rotational speed equal to or lower than a first predetermined speed, the determination control elements are arranged to periodically switch between a first processing executed to control the rotational speed of the combustion fan at a second predetermined speed higher than the predetermined speed for a first predetermined term (T2), and a second processing is executed to control the rotational speed of the combustion fan at the first predetermined speed for a second predetermined term (T1), and to repeatedly execute the determination by the clogging determination elements in a period when the first processing is executed and wherein during weak combustion, the burner burns at a combustion rate lower than a predetermined value.

8. The forced flue type combustion device according to claim 7, wherein the second predetermined term (T1) is less than the first predetermined term (T2).

* * * * *